US006354340B1

(12) United States Patent
Craine et al.

(10) Patent No.: US 6,354,340 B1
(45) Date of Patent: Mar. 12, 2002

(54) HAZARDOUS MATERIAL CATCHER

(76) Inventors: Edward M. Craine, 53-88 72nd Pl., Maspeth, NY (US) 11378; Dan Friedman, 1056 Elizabeth St., Baldwin, NY (US) 11510; Gary J. Parnahay, 81 Grant Dr. East, Valley Stream, NY (US) 11580

( * ) Notice: Subject to any disclaimer, the term of this patent is extended or adjusted under 35 U.S.C. 154(b) by 0 days.

(21) Appl. No.: 09/709,199

(22) Filed: Nov. 10, 2000

(51) Int. Cl.[7] ..... B65B 1/04; B65B 3/04; B67C 3/02

(52) U.S. Cl. ..... 141/86; 141/88; 137/312; 222/108

(58) Field of Search ..... 141/86, 88; 184/106; 222/108; 137/312, 313, 314

(56) References Cited

U.S. PATENT DOCUMENTS

| | | | | | |
|---|---|---|---|---|---|
| 702,181 | A | | 6/1902 | Boyd | |
| 1,997,529 | A | | 4/1935 | Miller | 65/61 |
| 3,422,469 | A | | 1/1969 | Tunstall et al. | 7/1 |
| 3,471,060 | A | | 10/1969 | Wright | 222/108 |
| 4,501,305 | A | | 2/1985 | Zola | 141/86 |
| 4,520,852 | A | * | 6/1985 | Klein | 141/86 |
| 4,579,155 | A | | 4/1986 | Zola | 141/86 |
| 4,695,088 | A | * | 9/1987 | Jensen | 296/38 |
| 4,750,388 | A | | 6/1988 | Hagen et al. | 81/64 |
| 5,065,648 | A | | 11/1991 | Hocfbaum, Jr. | 81/64 |
| 5,169,541 | A | * | 12/1992 | Wells | 210/767 |
| 5,339,872 | A | | 8/1994 | Marino | 141/1 |
| 5,379,810 | A | | 1/1995 | Marino | 141/10 |
| 5,484,635 | A | | 1/1996 | Andersen et al. | 428/40 |
| 5,571,249 | A | | 11/1996 | Boylen | 141/86 |
| 5,934,312 | A | | 8/1999 | Zola | 137/312 |

FOREIGN PATENT DOCUMENTS

| | | | |
|---|---|---|---|
| DE | 2800143 | 7/1979 | B67D/5/37 |
| FR | 1053574 | 9/1953 | 5/5 |

* cited by examiner

*Primary Examiner*—Timothy L. Maust
(74) *Attorney, Agent, or Firm*—Harvey Lunenfeld

(57) ABSTRACT

A hazardous material catcher, which maintains hazardous material spills and prevents spillage of hazardous materials during coupling, uncoupling, loading and unloading processes. The hazardous material catcher has absorbent material associated therewith to absorb excess hazardous materials and prevent hazardous materials from contacting neighboring areas. The hazardous material catcher is light weight, portable, easy to mount, easy to transport, and has absorbent material associated therewith that is easily disposable in a safe and environmentally sound manner, and is useable in a variety of hazardous material loading and unloading applications, including vehicle to vehicle, vehicle to stationary, stationary to vehicle, and stationary to stationary applications. The hazardous materials may be fuel of all types, including gasoline, jet fuel, oil, chemicals, and hazardous material of all types, and prevents excess hazardous material and material that might exit, drip, and/or seep from and around couplings from contacting neighboring areas, and absorbs seeping, dripping, and/or excess hazardous material. The hazardous material catcher is capable of being quickly, conveniently, and easily removably placed adjacently around the entrance inlet and/or outlet orifices of a variety of vehicles, tanks, and storage locations, is portable, light weight, stores easily, and is useable in a variety of applications. The hazardous material catcher has a clamp adapted to be coupled to a discharge outlet or inlet of a tanker truck, a support adjoined thereto the clamp; and absorbent material, which is replaceable and substantially impervious to hazardous material strikethrough, the support supporting the absorbent material.

20 Claims, 6 Drawing Sheets

FIG. 3A
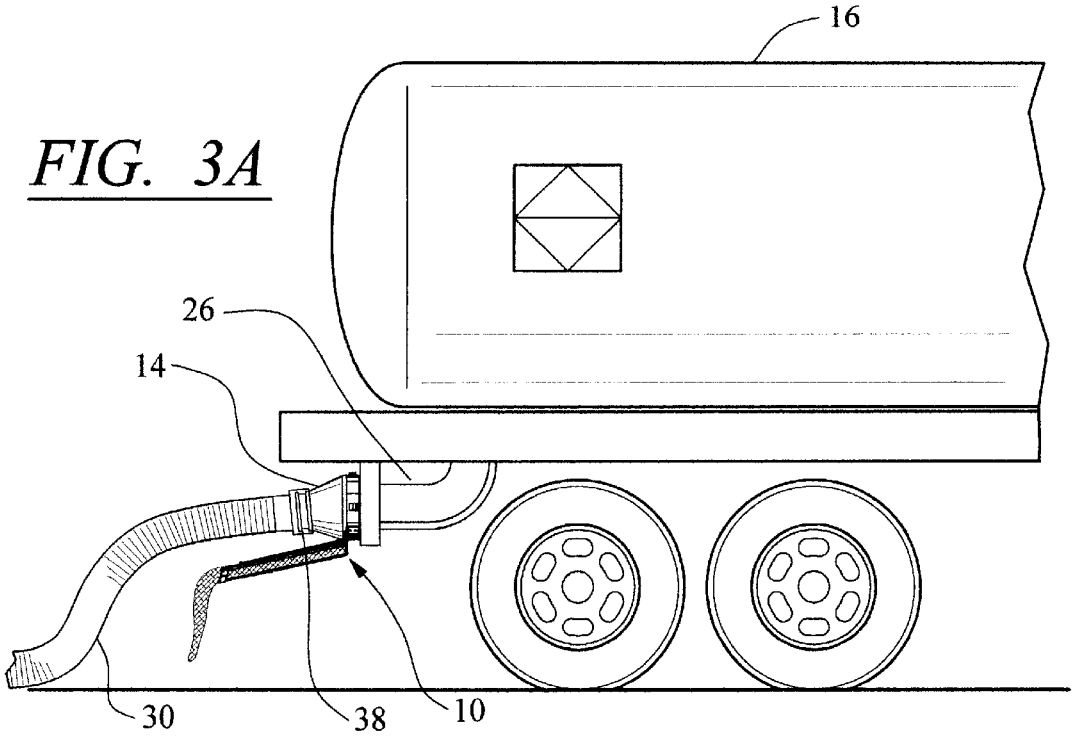
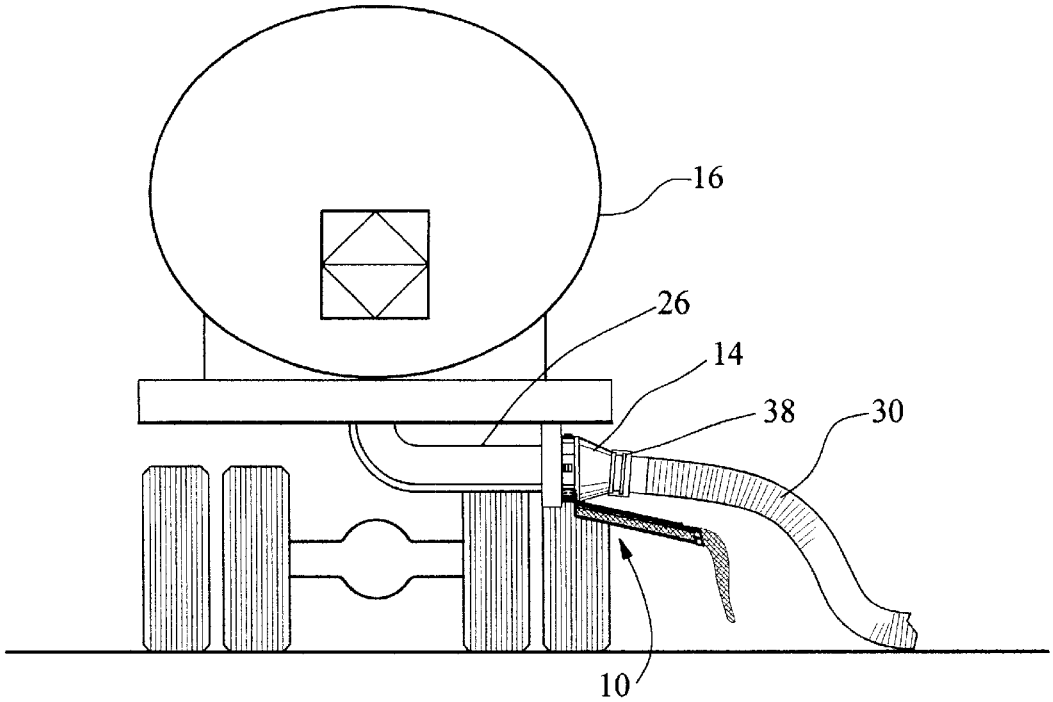
FIG. 3B

FIG. 5
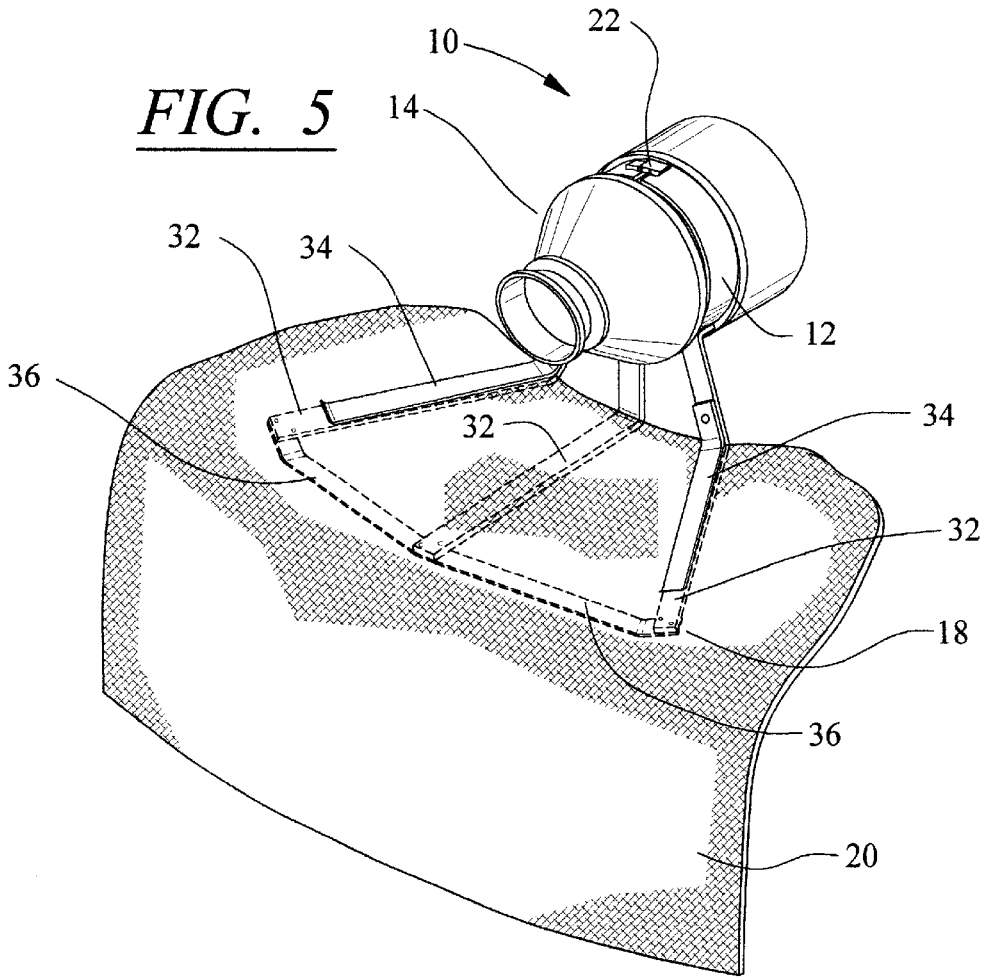
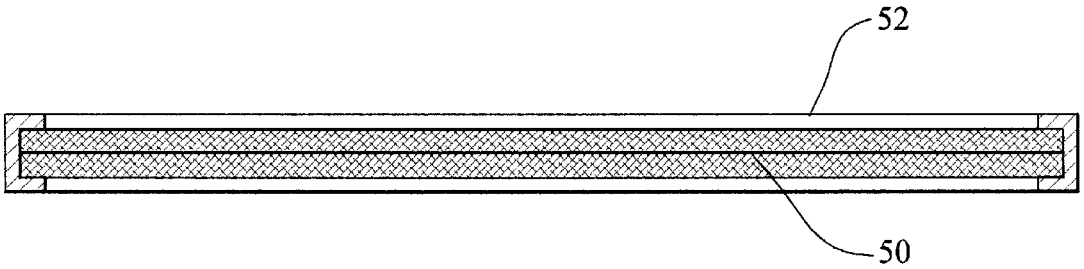
FIG. 6

HAZARDOUS MATERIAL CATCHER

BACKGROUND OF THE INVENTION

1. Field of the Invention

The present invention relates generally to hazardous material collection devices and more particularly to hazardous material collection devices for vehicles.

2. Background Art

Hazardous materials are often transported from storage facilities and delivered to their destinations by tanker truck, on-loaded and off-loaded thereinto and therefrom the tanker truck theretbrough flexible hose and piping. The hazardous materials are loaded thereinto the tanker truck therefrom the storage facility, transported to their destination onboard the tanker truck, and unloaded therefrom the tanker truck thereinto holding facilities at the premises of their destination. Typically, a discharge hose is coupled to the discharge outlet of the tanker truck, and an opposing end is coupled to the inlet at the holding facility at the destination location. Hazardous materials may typically spill at the coupling points during the coupling, uncoupling, and loading and unloading processes. The hazardous materials may be fuel of all types, including gasoline, jet fuel, oil, chemicals, and hazardous material of all types.

A hazardous material catcher is needed, which maintains hazardous material spills and prevents spillage of hazardous materials during coupling, uncoupling, loading and unloading processes. The hazardous material catcher should have absorbent material associated therewith to absorb excess hazardous materials and prevent hazardous materials from contacting neighboring areas. The hazardous material catcher should be light weight, portable, easy to mount, easy to transport, and have absorbent material associated therewith that is easily disposable in a safe and environmentally sound manner. The hazardous material catcher should be useable in a variety of hazardous material loading and unloading applications, including vehicle to vehicle, vehicle to stationary, stationary to vehicle, and stationary to stationary applications. The hazardous materials may be fuel of all types, including gasoline, jet fuel, oil, chemicals, and hazardous material of all types.

The hazardous material catcher should shield prevent excess hazardous material and material that might exit, seep, and/or drip from and around coupling from contacting neighboring areas, and absorb seeping, dripping and/or excess hazardous material. The hazardous material catcher should be capable of being quickly, conveniently, and easily movably placed adjacently around the entrance inlet and/or outlet orifices of a variety of vehicles, tanks, and storage locations, be portable, light weight, stored easily, and be useable in a variety of applications. The hazardous material catcher should also be durable, inexpensive, safe to use, attractive, sturdy, and of simple construction. The absorbent material associated therewith the hazardous material catcher should be replaceable, substantially impervious to hazardous material strikethrough, and easily disposable in a safe and environmentally sound manner.

Different catching devices and the like have been known. However, none of the catching devices adequately satisfies these aforementioned needs.

French Patent No. 1,053,574 (Establissements Boutillon S.A.) discloses a gasoline pump type filling nozzle having a bowl around the spout, above the handle, which catches drippings and prevents liquids from flowing back towards the filler handle.

German Patent No. DT 2800143 (Eichnere) discloses a gasoline/diesel pump filling nozzle having a ring of absorbent material for preventing hands of successive users from being soiled by gasoline/diesel fuel drippings from the filling nozzle. The ring of absorbent material around the spout, above the handle, catches the drippings after the nozzle has being used and hung up, thus, preventing the hands of the next user from being soiled. The absorbent material can be paper, foam or another suitable substance.

U.S. Pat. No. 702,181 (Boyd) discloses a drip attachment having a receptacle for catching drippings from a liquid dispensing apparatus, and in particular drippings from a soda fountain draw-off faucet, when the draw-off faucet is closed and not in use.

U.S. Pat. No. 1,997,529 (Miller) discloses a pitcher drainage frame for accumulating condensate, which may form around a pitcher containing an iced or chilled liquid, and for accumulating drippings from the pitcher spout.

U.S. Pat. No. 5,065,648 (Hocfbaum, Jr.) discloses an oil filter wrench having two semi-circular, semi-rigid sections, each of which includes a plurality of shark tooth-shaped projections which engage an oil filter of an internal combustion engine so that the wrench can engage the oil filter in a non-slipping manner without substantially damaging or marring that oil filter, and U.S. Pat. No. 3,422,469 (Tunstall et al) discloses a hose coupling tool. U.S. Pat. No. 4,750,388 (Hagen et al) discloses an oil filter gripping tool having a looped band, the ends of which are connected to scissors levers through a pair of double pivot hinges.

U.S. Pat. No. 5,571,249 (Boylen) discloses a fluid sleeve for channeling fluid spilled during the servicing of a motorized vehicle having a top portion, a bottom portion, and an enclosed body portion extending between the top portion and the bottom portion. The body portion defines a first opening operable to engage a fluid inlet of the motorized vehicle and a second opening operable to engage a fluid outlet of a fluid container received therethrough to be disposed in the fluid inlet. In use, when fluid is discharged or otherwise spilled from the fluid inlet or the fluid outlet during servicing, the fluid is retained within the body portion and channeled toward the bottom portion.

U.S. Pat. No. 5,339,872 (Marino) discloses a spill containment bag for use with a container having a leak. The spill containment bag has a flexible bag member defining an enclosure and having a lower section with a bottom wall and a sidewall extending upwardly and inwardly from the periphery of the bottom wall to a reduced cross section at its upper end intermediate the height of the bag member. The bag member also has an upper section with a sidewall extending upwardly therefrom, and the sidewall of the upper section has at least its upper portion extending outwardly to provide an opening of enlarged cross section at the upper end of the bag member. At least one strap is provided to secure the bag member to a leaking container so as to position the opening at the upper end thereof beneath the point of leakage.

U.S. Pat. No. 5,484,635 (Andersen et al) discloses a multipurpose drip catcher, i.e., a sanitary household or laboratory article in the form of a multi-purpose drip catcher of the apply-and-discard type, formed as a small, essentially flat pocket made from water-proof non-transparent foil material, which pocket is open in its upward direction and the walls of which are glued or welded together along the pocket borders. The back wall of the pocket is provided with an adhesive for application of the pocket onto a container wall. The inside of the pocket is essentially filled with a strongly absorbing hydrophilic material, and the pocket may additionally be provided with saturation indicator for disclosing the saturation of the material with liquid.

U.S. Pat. No. 5,379,810 (Marino) discloses a spill containment bag for use about the coupling of a tank port and a conduit. The spill containment bag has a flexible bag member defining an enclosure with a pair of opposing apertures in its sidewall to permit passage therethrough of the tank port and the conduit; the sidewall seats snugly about the elements passing therethrough so as to provide a seal. The top wall of the bag provides a disengageable closure for the bag to permit access to its interior. One or more vents may be provided to permit air to flow therethrough, and carrying straps are also provided. To seal the bag, flaps cover the apertures and the vents. In use, the top wall is opened to permit coupling the conduit to the tank port, and the vents may be opened as required for the particular operation. When the operation is complete, the conduit is disconnected and the flaps overlying the apertures and the vents are closed to permit transport of the bag with its contents.

U.S. Pat. No. 3,471,060 (Wright) discloses a drip catcher and deflector for bath tub faucets and the like having a deflecting member formed of absorbent and resilient material, such as synthetic sponge, and a strap for mounting the deflecting member to the faucet. A portion of the deflecting member extends laterally under the outlet of the faucet and acts to catch drippings and deflect the drippings from the faucet, so that the drippings falls within the drain outlet of the tub, rather than running down a portion of the tub wall where the drippings might deposit dissolved minerals causing staining.

U.S. Pat. Nos. 4,501,305 and 4,579,155 (Zola) each disclose a receptacle for collecting gasoline fuel spills having an outer flexible wall and a bottom pervious wall. The outer flexible wall is provided with a tie string in the neck thereof whereby the receptacle may be sealed by pulling the tie string together. A central aperture is provided in the bottom pervious wall. Secured within the central aperture is a central flexible wall having an upper and extending above an upper end of the receptacle. The upper end of the tubular central wall has a tie string therein for securing the neck of the tubular inner wall against a till pipe of a gasoline underground tank. The receptacle contains layers of absorbent material for absorbing gasoline which may spill out of the fill pipe during filling of the underground tank. When the absorbent materials absorb sufficient gasoline, the receptacle may be removed from about the fill pipe and the drawing strings pulled together to contain the absorbed gasoline within the receptacle.

U.S. Pat. No. 5,934,312 (Zola) discloses a drop chute spill guard for containing spills in conjunction with a loading hose supplying fuel to an in-ground storage tank. The spill guard has a flexible barrier sized to surround a sump, an absorption layer disposed covering the flexible barrier, and a sealing ring with a stiffener ring secured to the flexible barrier and having an outside diameter substantially corresponding to a diameter of the sump. An opening is disposed in the vicinity of the tank inlet and extends through the absorption layer, the flexible barrier, the sealing ring, and the stiffener ring for receiving the drop chute. The arrangement provides spill containment with a portable apparatus. The absorption layers may be replaced in the event of contamination, and the sealing ring is provided with a stepped outside diameter to accommodate varying sump diameters.

For the foregoing reasons, there is a need for a hazardous material catcher, which maintains hazardous material spills and prevents spillage of hazardous materials during coupling, uncoupling, loading and unloading processes. The hazardous material catcher should have absorbent material associated therewith to absorb excess hazardous materials and prevent hazardous materials from contacting neighboring areas. The hazardous material catcher should be light weight, portable, easy to mount, easy to transport, and have absorbent material associated therewith that is easily disposable in a safe and environmentally sound manner. The hazardous material catcher should be useable in a variety of hazardous material loading and unloading applications, including vehicle to vehicle, vehicle to stationary, stationary to vehicle, and stationary to stationary applications. The hazardous materials may be fuel of all types, including gasoline, jet fuel, oil, chemicals, and hazardous material of all types.

The hazardous material catcher should prevent excess hazardous material and material that might exit, seep and/or drip from and around coupling from contacting neighboring areas, and absorb seeping, dripping, and/or excess hazardous material. The hazardous material catcher should be capable of being quickly, conveniently, and easily removably placed adjacently around the entrance inlet and/or outlet orifices of a variety of vehicles, tanks, and storage locations, be portable, light weight, stored easily, and be useable in a variety of applications. The hazardous material catcher should also be durable, inexpensive, safe to use, attractive, sturdy, and of simple construction. The absorbent material associated therewith the hazardous material catcher should be replaceable, substantially impervious to hazardous material strikethrough, and easily disposable in a safe and environmentally sound manner.

SUMMARY

The present invention is directed to a hazardous material catcher, which maintains hazardous material spills and prevents spillage of hazardous materials during coupling, uncoupling, loading and unloading processes. The hazardous material catcher has absorbent material associated therewith to absorb excess hazardous materials and prevent hazardous materials from contacting neighboring areas. The hazardous material catcher is light weight, portable, easy to mount, easy to transport, and has absorbent material associated therewith that is easily disposable in a safe and environmentally sound manner. The hazardous material catcher is useable in a variety of hazardous material loading and unloading applications, including vehicle to vehicle, vehicle to stationary, stationary to vehicle, and stationary to stationary applications. The hazardous materials may be fuel of all types, including gasoline, jet fuel, oil, chemicals, and hazardous material of all types.

The hazardous material catcher prevents excess hazardous material and material that might exit, drip, and/or seep from and around couplings from contacting neighboring areas, and absorbs seeping, dripping, and/or excess hazardous material. The hazardous material catcher is capable of being quickly, conveniently, and easily removably placed adjacently around the entrance inlet and/or outlet orifices of a variety of vehicles, tanks, and storage locations, is portable, light weight, stores easily, and is useable in a variety of applications. The hazardous material catcher is also durable, inexpensive, safe to use, attractive, sturdy, and of simple construction. The absorbent material associated therewith the hazardous material catcher is easily disposable in a safe and environmentally sound manner.

A hazardous material catcher having features of the present invention comprises: a clamp adapted to be coupled to a discharge outlet or inlet of a tanker truck, a support adjoined thereto the clamp; and absorbent material, which is replaceable and substantially impervious to hazardous material strikethrough, the support supporting the absorbent material.

DRAWINGS

These and other features, aspects, and advantages of the present invention will become better understood with regard to the following description, appended claims, and accompanying drawings where:

FIG. 3A is a side view of the hazardous material catcher showing the side of the tanker truck and the hazardous material catcher coupled to a discharge outlet at rear of the tanker truck;

FIG. 3B is a side view of the hazardous material catcher showing the back of the tanker truck and the hazardous material catcher coupled to a discharge outlet at a side of the tanker truck;

FIG. 5 is a perspective view of the hazardous material catcher coupled to the discharge outlet of the tanker truck;

FIG. 6 is a side view of absorbent material therein a frame, which may be used with the hazardous material catcher;

DESCRIPTION

Figure 1:
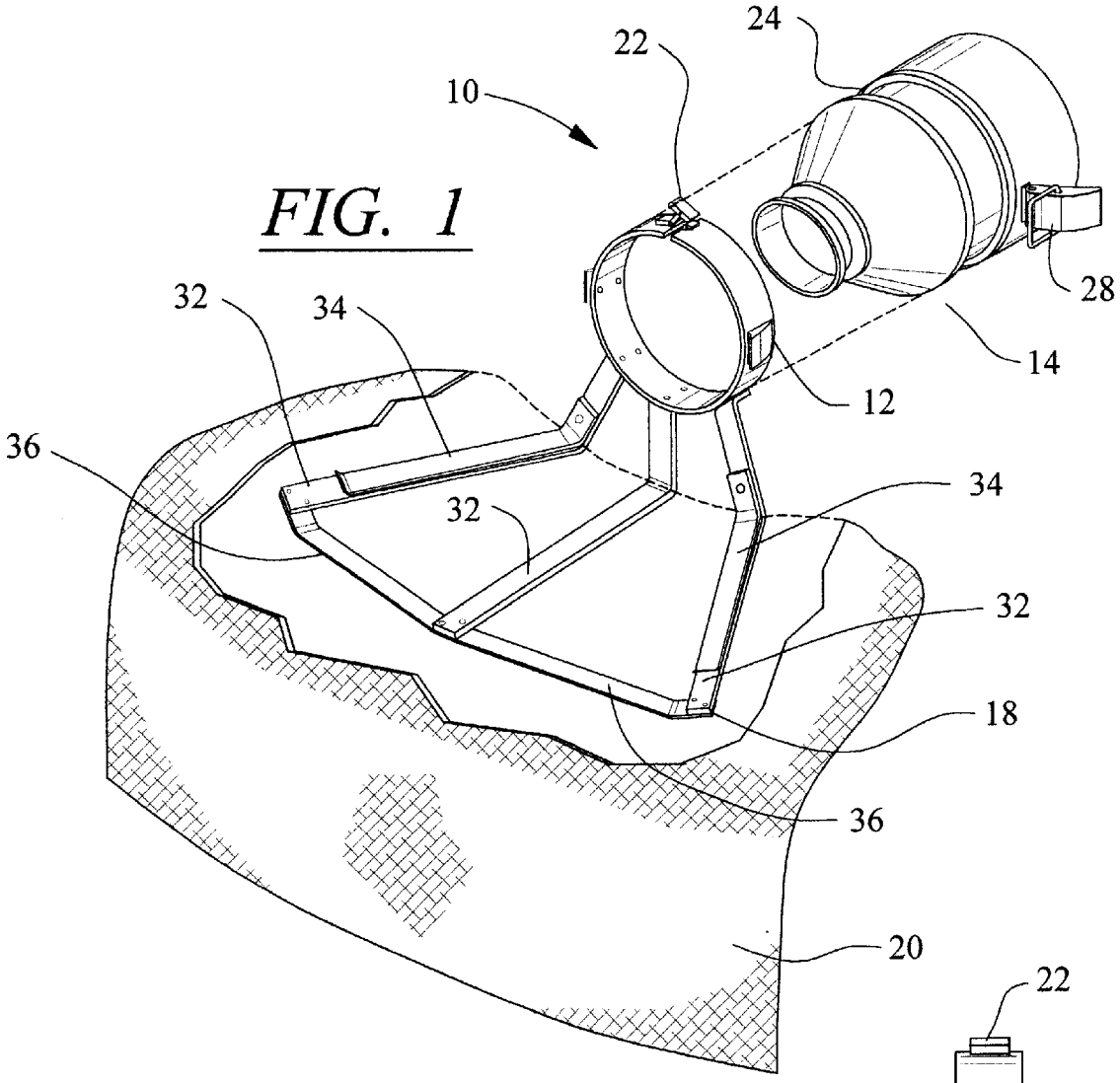
FIG. 1 is a perspective view of a hazardous material catcher, constructed in accordance with the present invention, adjacent a discharge outlet of a tanker truck.
Figure 2:
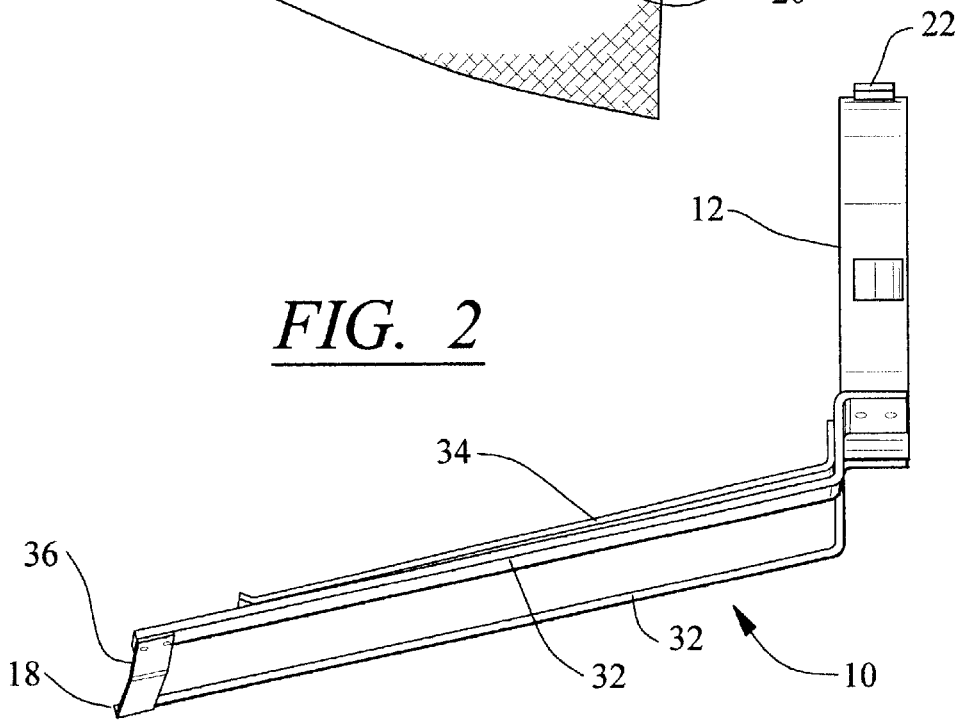
FIG. 2 is a side view of the hazardous material catcher, constructed in accordance with the present invention.
Figure 4:
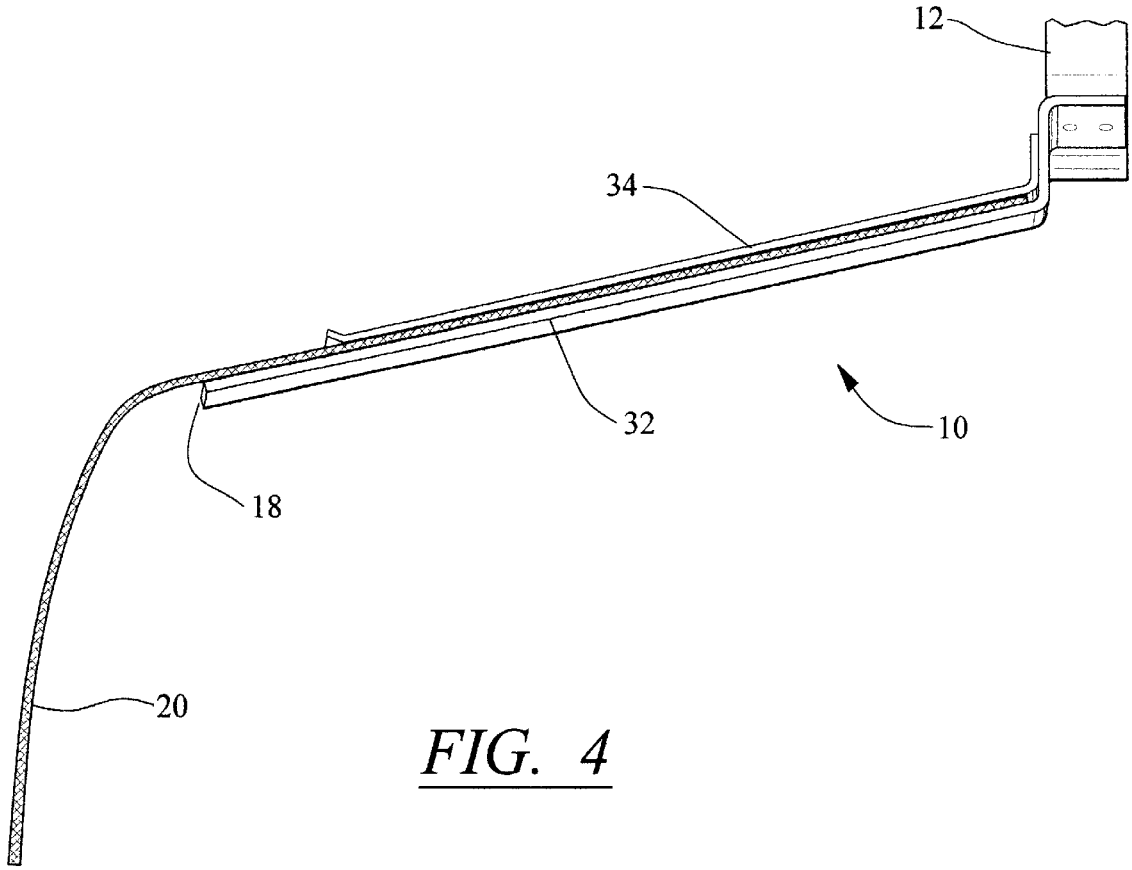
FIG. 4 is an enlarged side view of a portion of the hazardous material catcher of FIG. 2.

The preferred embodiments of the present invention will be described with reference to FIGS. 1–9 of the drawings. Identical elements in the various figures are identified with the same reference numbers.

FIGS. 1–5 show an embodiment of the present invention, a hazardous material catcher 10 having a clamp 12 adapted to be coupled to a discharge outlet 14 or inlet of a tanker truck 16, support 18 adjoined thereto the clamp 12, and absorbent material 20, the support 14 supporting absorbent material 20, which is replaceable and substantially impervious to hazardous material strikethrough. The clamp 12 has a releasable locking latch 22 and may be of resilient material, which allows the clamp to closely fit and conform to the shape of outer circumference 24 of the discharge outlet 14, which is releasably coupled to discharge pipe 26 of the tanker truck 16. The clamp 12 is substantially similar to a typical hose clamp having a releasable locking latch.

The discharge outlet 14 is releasably coupled to the discharge pipe 26 of the tanker truck 16, and locked in place about the discharge pipe with releasable locking latches 28. The clamp 12 fits about the releasable locking latches 28 and the outer circumference 24 of the discharge outlet 14, and provides an additional function and safety feature of locking and maintaining the releasable locking latches 28 in place, even during periods of excessive vibration, thus preventing the discharge outlet 14 from accidentally uncoupling from the discharge pipe 26. Discharge hose 30 is coupled to the discharge outlet 14.

The support 18 has support members 32 adjoined thereto the clamp 12, finger members 34 for releasably locking the absorbent material 20 therebetween the finger members 34 and the support members 32, and holding the absorbent material 20 in place, during operation and use. Member 36 affixed to and therebetween the support members 32 provides additional structural rigidity to the support 18 and provides additional support for the absorbent material 20. The member 36 may, however, be removed. The support members 32 may be L shaped for improved clearance therebetween the discharge hose 30 and the support members 32.

A primary source of potential leakage and/or spillage of hazardous material may occur at the junction 38 of the discharge hose 30 and the discharge outlet 14. The hazardous material catcher 10 absorbs such leakage and/or spillage of hazardous material, and prevents the hazardous material from reaching the ground and preventing an environmental hazard. Hazardous materials, liquids, fuels, and lubricants contacting the absorbent material 20 may typically be contained within the absorbent material 12 and prevented from reaching adjacent surfaces. The absorbent material 20 may be of woven polypropylene or other suitable material, which is replaceable and substantially impervious to hazardous material strikethrough and/or liquid strikethrough. The absorbent material 20 is typically barrier sorbent material, which is hydrophilic and oleophilic and is constructed of hydrophilic and oleophilic material.

The hazardous material catcher 10 may be used to prevent overflow, spillage, and splashes of hazardous materials, liquids, fuel and/or lubricant from contacting surfaces adjacent a hazardous material, liquid, fuel, and/or lubricant discharge outlet of the tanker truck, vehicle, or stationary tank during loading and/or unloading processes.

FIG. 6 is shows an alternate absorbent material 50 therein a frame 52, which may be used with the hazardous material catcher 10.

Figure 7:
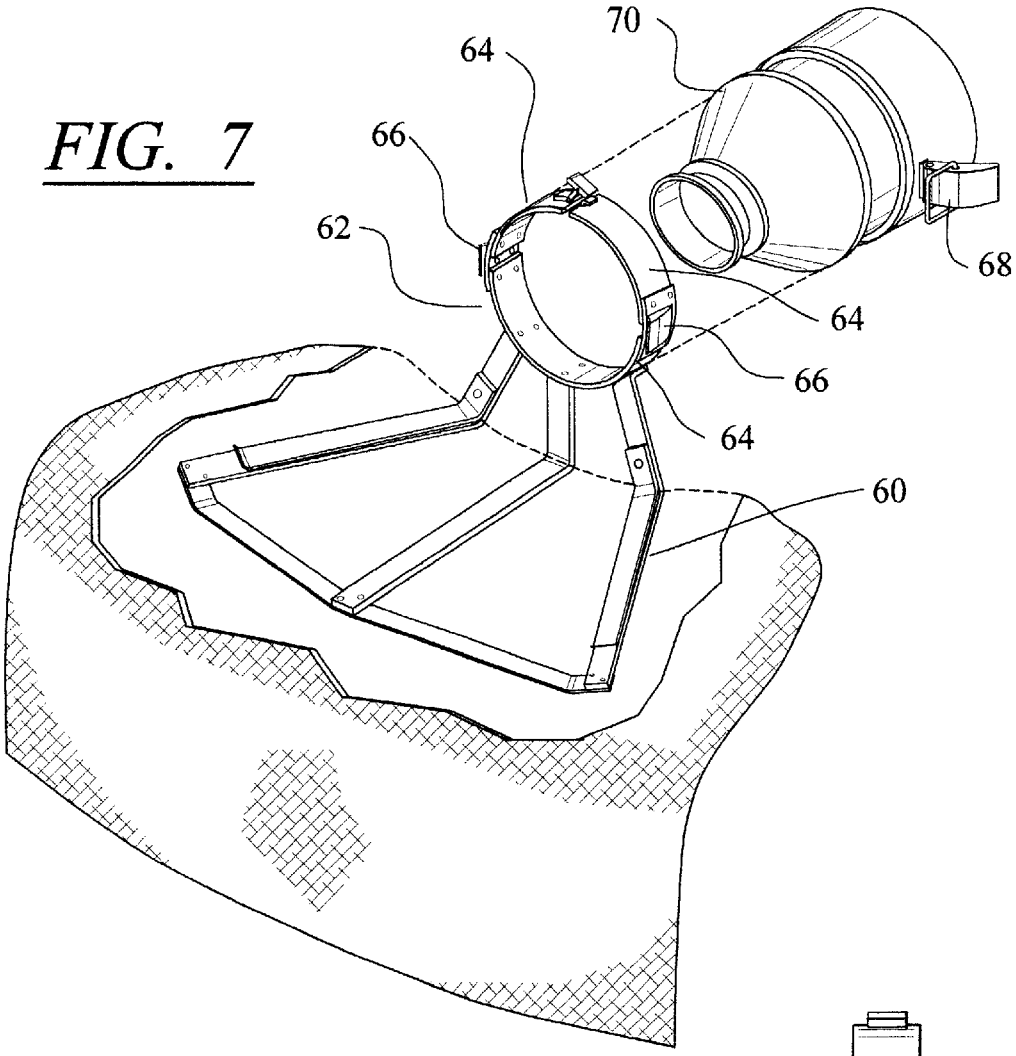
FIG. 7 is a perspective view of an alternate embodiment of a hazardous material catcher, constructed in accordance with the present invention, adjacent a discharge outlet of a tanker truck.
Figure 8:
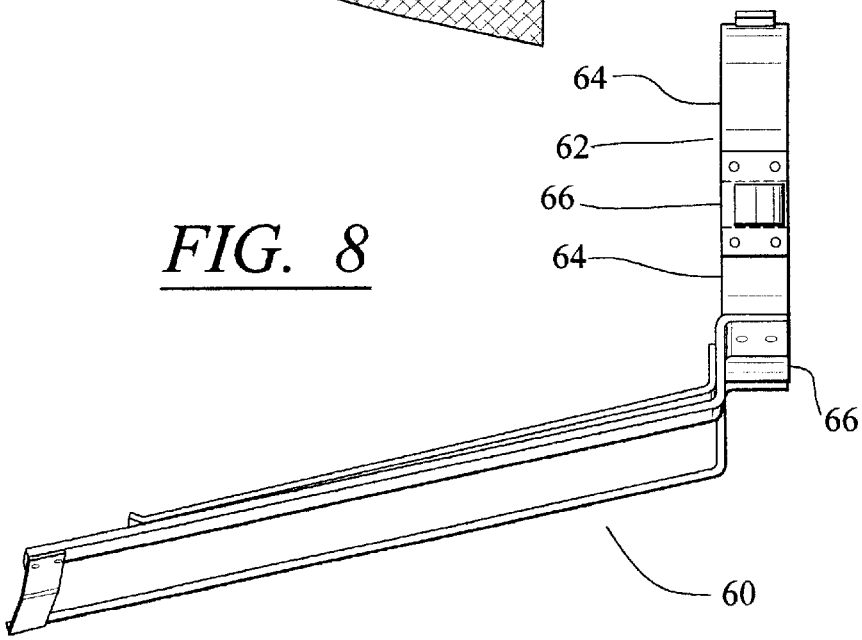
FIG. 8 is a side view of the alternate embodiment of the hazardous material catcher, constructed in accordance with the present invention of FIG. 7.

FIGS. 7 and 8 shows an alternate embodiment of a hazardous material catcher 60, which is substantially the same as the hazardous material catcher 10, except that the hazardous material catcher 60 has a clamp 62 having arcuate sections 64 and raised arcuate sections 66 adapted to fit about locking latches 68 of discharge outlet 70.

Figure 9:
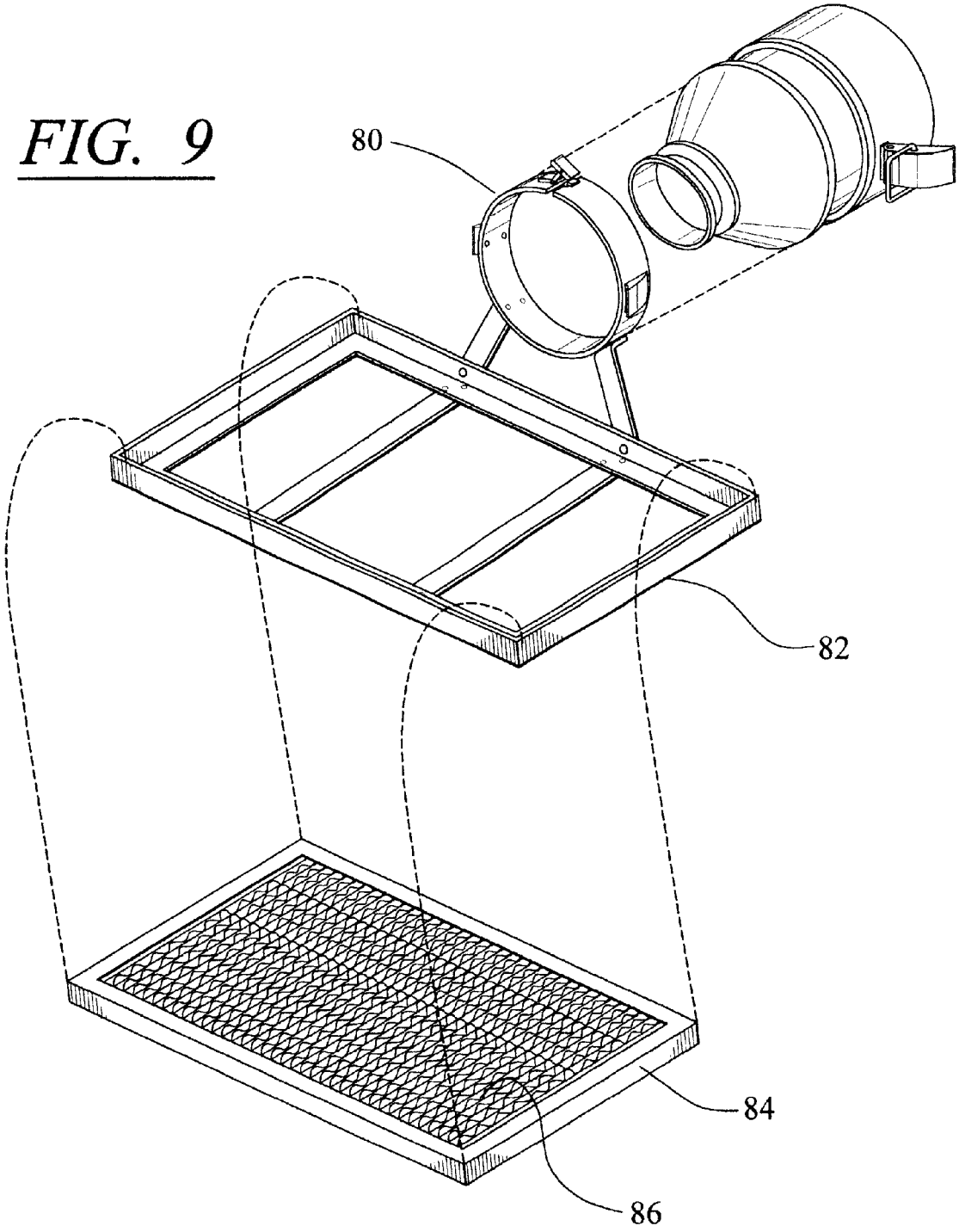
FIG. 9 is a perspective view of another alternate embodiment of a hazardous material catcher, constructed in accordance with the present invention, adjacent a discharge outlet of a tanker truck.

FIG. 9 shows another alternate embodiment of a hazardous material catcher 80, which is substantially the same as the hazardous material catcher 10, except that the hazardous material catcher 80 has a support 82 for supporting a drop in frame 84 having absorbent material 86 therein.

Although the present invention has been described in considerable detail with reference to certain preferred versions thereof, other versions are possible. Therefore, the spirit and scope of the appended claims should not be limited to the description of the preferred versions contained herein.

What is claimed is:

1. A hazardous material catcher comprising:

a clamp adapted to be coupled to an outlet or inlet of a tanker truck or storage tank;

a support adjoined thereto said clamp; and absorbent material, which is replaceable and substantially impervious to hazardous material strikethrough;

said support supporting said absorbent material;

said support having releasable fasteners adapted to allow replacement of and releasably lock said absorbent material therein.

2. The hazardous material catcher according to claim 1, wherein said clamp has a releasable locking latch, adapted to allow said hazardous material catcher to be releasably coupled to said discharge outlet or inlet.

3. The hazardous material catcher according to claim 1, wherein said releasable fasteners have finger members adapted to allow replacement of and releasably lock said absorbent material.

4. The hazardous material catcher according to claim 1, wherein said clamp is of resilient material, which allows said clamp to closely fit and conform to the shape of outer circumference of said discharge outlet or inlet.

5. The hazardous material catcher according to claim 1, wherein said absorbent material is constructed of barrier sorbent material.

6. The hazardous material catcher according to claim 1, wherein said absorbent material is constructed of nonwoven polypropylene.

7. The hazardous material catcher according to claim 1, wherein said absorbent material is constructed of hydrophilic and oleophilic material.

8. The hazardous material catcher according to claim 1, wherein said clamp is a hose clamp.

9. The hazardous material catcher according to claim 1, wherein said clamp is flexible.

10. The hazardous material catcher according to claim 1, wherein said clamp has sections adapted to fit about locking latches of said outlet or inlet.

11. A hazardous material catcher comprising:

a clamp adapted to be coupled to an outlet or inlet of a tanker truck or storage tank;

a support adjoined thereto said clamp; and a drop in replaceable frame having absorbent material therein, said absorbent material being substantially impervious to hazardous material strikettrough;

said support supporting said drop in replaceable frame having said absorbent material therein.

12. The hazardous material catcher according to claim 11, wherein said clamp has a releasable locking latch, adapted to allow said hazardous material catcher to be releasably coupled to said discharge outlet or inlet.

13. The hazardous material catcher according to claim 11, wherein said clamp is of resilient material, which allows said clamp to closely fit and conform to the shape of outer circumference of said discharge outlet or inlet.

14. The hazardous material catcher according to claim 11, wherein said absorbent material is constructed of barrier sorbent material.

15. The hazardous material catcher according to claim 11, wherein said absorbent material is constructed of nonwoven polypropylene.

16. The hazardous material catcher according to claim 11, wherein said absorbent material is constructed of hydrophilic and oleophilic material.

17. The hazardous material catcher according to claim 11, wherein said absorbent material is replaceable.

18. The hazardous material catcher according to claim 11, wherein said clamp is a hose clamp.

19. The hazardous material catcher according to claim 11, wherein said clamp is flexible.

20. The hazardous material catcher according to claim 11, wherein said clamp has sections adapted to fit about locking latches of said outlet or inlet.

* * * * *